US006619653B2

(12) United States Patent
Dobrindt

(10) Patent No.: US 6,619,653 B2
(45) Date of Patent: Sep. 16, 2003

(54) OFFSET SHEET STACKER HAVING DEFLECTION WHEELS MOUNTED OF A SHAFT INCLINED TO SHEET TRANSPORT DIRECTION

(75) Inventor: Dirk Dobrindt, Klausdorf/Schwentine (DE)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 09/989,773

(22) Filed: Nov. 20, 2001

(65) Prior Publication Data

US 2002/0063378 A1 May 30, 2002

(30) Foreign Application Priority Data

Nov. 28, 2000 (DE) ..... 100 59 005

(51) Int. Cl.[7] ..... B65H 29/00

(52) U.S. Cl. ..... 271/83; 271/315; 271/187; 414/791.2

(58) Field of Search ..... 271/187, 314, 271/315, 81, 82, 83; 414/791.2

(56) References Cited

U.S. PATENT DOCUMENTS 4,252,309 A * 2/1981 Garrison et al. ..... 271/186
4,431,177 A * 2/1984 Beery et al. ..... 271/186
4,969,641 A * 11/1990 Fukushima et al. ..... 271/187
5,065,997 A * 11/1991 Butts et al. ..... 271/187
5,114,135 A * 5/1992 Evangelista et al. ..... 271/187
5,145,167 A * 9/1992 McGraw et al. ..... 271/186
5,476,256 A * 12/1995 Fortuna et al. ..... 271/187
5,489,092 A * 2/1996 Kimura et al. ..... 271/185
5,512,996 A * 4/1996 Fare ..... 399/404
5,732,943 A * 3/1998 Delfosse ..... 271/228
5,803,705 A * 9/1998 Keyes ..... 414/793.9
6,443,450 B1 * 9/2002 Antinora ..... 271/315

FOREIGN PATENT DOCUMENTS

| | | |
|---|---|---|
| DE | 2 309 075 | 8/1974 |
| EP | 0 838 421 A2 | 4/1998 |
| GB | 1 594 488 | 7/1981 |

OTHER PUBLICATIONS

JP 01271365A (Oct. 30, 1989), In: Patent Abstracts of Japan.

* cited by examiner

*Primary Examiner*—Patrick Mackey
(74) *Attorney, Agent, or Firm*—Lawrence P. Kessler

(57) ABSTRACT

An offset sheet stacker device for flexible sheet material (2), especially paper, with at least one deflection wheel (3) which has at least one receiving slot (4) which is located essentially tangentially, a sheet feed device (5) which discharges into at least one receiving slot (4) when it is in the receiving position (6), and a sheet delivery stop (7) in the area of the deflection wheel (3) which is opposite a receiving position (6), the wheel running in a recess (8) of said sheet delivery stop (7) and the latter lying in the sheet delivery position (17) at least on one side of said receiving slot (4). On one shaft (9) there are at least two deflection wheels (3) which have receiving slots (4) in identical positions and that the shaft (9) can be inclined relative to the transport direction (10) of the sheet feed device (5).

13 Claims, 5 Drawing Sheets

OFFSET SHEET STACKER HAVING DEFLECTION WHEELS MOUNTED OF A SHAFT INCLINED TO SHEET TRANSPORT DIRECTION

FIELD OF THE INVENTION

The invention relates to a sheet delivery device for flexible sheet material, especially paper, with at least one deflection wheel which has at least one receiving slot which is located essentially tangentially, a sheet feed guide which discharges into at least one receiving slot when it is in a receiving position and a sheet delivery stop in the area of the deflection wheel which is opposite a receiving position, the wheel running in a recess of the sheet delivery stop and the latter lying in the sheet delivery position at least on one side of the receiving slot.

BACKGROUND OF THE INVENTION

One typical sheet delivery device is known from DE 23 09 075 A1. In this sheet delivery device an even stack is produced. But it is often necessary for an offset to be formed in the stack in the tray after a certain number of sheets. This can be used for example to better acquire the total number of sheets. This is especially important when different sheets, which belong together, are being continuously printed. This is often the case in electrophotographic printing machines. Then it is necessary for one job to be separated from another by this offset.

SUMMARY OF THE INVENTION

Therefore the object of the invention is to develop a sheet delivery device of the type such that an offset in the delivered stack can be easily produced.

This invention is done in that on one shaft there are at least two deflection wheels which have receiving slots in identical positions, and that the one shaft can be inclined relative to the sheet transport direction of the sheet feed guide. By this invention, with a simple development it becomes possible to produce an offset at any time without interrupting the sheet delivery. In this way it is possible for example to separate one job from another even if the jobs each have a different number of sheets. Furthermore it is also possible to use the invention is a smaller correcting range to control the delivery position of the sheets, to correct deviations and thus to neatly stack sheets which belong together on top of one another.

The function of the invention is for the sheet material to run into the receiving slots and after 90° rotation to be inclined by the same angle as the shaft with the deflection wheels. If at this point the deflection wheels continue to move and in doing so guide the sheet material to the sheet delivery stop, rotation by roughly 180° takes place so that the sheet is inclined by twice the angle as the shaft. If one part of the stack is to be offset relative to another, the shaft is inclined from its perpendicular position to the transport direction preferably once in one direction and once in the other direction so that the offset is an angular offset of one part of the stack relative to the other part of the stack which is four times the incline of the shaft. Of course the shaft could also be aligned once perpendicular to the transport direction and could be inclined for the next part of the stack.

Feasibly, the deflection wheels are made such that they each have two receiving slots offset by 180°. Thus the delivery position of one of the receiving slots is identical to the receiving position of the receiving slots offset by 180°. In this way the deflection wheels can pick up a new sheet with each revolution and can deliver the previous sheet.

When a sheet is fed, it must be ensured that the receiving slots of the two deflection wheels are in the receiving position. This can be done by there being a plurality of receiving slots on the deflection wheels and their having an opening so large that in each position of the deflection wheels there are receiving slots in the receiving position. This is the proposal of DE 23 09 075 A1. But it is also possible to ensure by other means that with sheet feed the receiving slots are in the receiving position. For example, one proposal calls for there to be a braking device which stops the deflection wheels in at least one receiving position. For example, there can be a cam disk against which an element presses, and the element must overcome elevations of the cam disk in the receiving positions.

To achieve the motion of the deflection wheels which is necessary for sheet delivery, it can be provided that the deflection wheels are made with respect to their weight and the shaft is made with respect to its bearing such that the deflection wheels can be driven by the feed of the sheet material.

One alternative calls for there to be a drive for the deflection wheels. Then, instead of the braking device it can be provided that the drive is made such that it stops the deflection wheels in the receiving positions. For example, a stepping motor can be used for this purpose.

So that the drive can drive the shaft even when it is in an inclined position, it is possible to place it directly on the shaft so that it keeps up with the inclined position. But alternatively it can also be provided that the drive is located in the machine housing and transmission to the shaft takes place. If for example the shaft is swiveled around a swiveling axis, it can be provided that the swiveling axis is made as a hollow shaft in which there is a power transmission shaft.

Preferably the receiving slots are made V-shaped at the start of the slot. In this way it is ensured that the sheet material is reliably picked up and the receiving slot can be made so narrow after the start of the slot that the sheet material is securely held.

In order to achieve a neat angular offset of the sheet material, the slots should be made as narrow as possible. To prevent rebound by striking the end of the slot it is suggested that on at least one receiving slot there is a braking device for the sheet material which reduces its speed before striking the slot end such that no rebounding occurs on the stops. There are various possibilities for this braking device. One proposal calls for the braking device being made as elastic brackets which are located in the area of the receiving slots and which have friction relative to the sheet material. For example, rubber brackets can be used.

One feasible embodiment of the aforementioned development calls for the brackets to be movable into the insertion path of the sheet material. In this way it is possible to move them in the receiving position into the insertion path and in the delivery position to remove them from the path so that sheet delivery is not hindered. It is therefore proposed that the braking device be released for the sheet material in the sheet delivery position. The braking device can pass into the engagement and release position for example by an eccentrically supported weight which conveys the brackets in the receiving position into the insertion path and removes them again in the delivery position from the area of the receiving slots.

One development calls for the sheet delivery stop to be adjustable with respect to its angular position. Then an adjustment can be made according to the inclination of the shaft. But it can also be provided that the angular position of the sheet delivery stop is coupled to the angular position of the shaft such that the inclination of the sheet delivery stop always corresponds to twice the angle of inclination of the shaft. In this way the sheet delivery stop automatically has the correct position.

One alternative embodiment calls for the shaft to be inclinable from the perpendicular to the transport direction in both directions by a predetermined angle and for the sheet delivery stop to be made V-shaped, each leg of the V having twice the angle as the angle predetermined for the shaft. In this way the angular offset in delivery is dictated, but adjustment of the sheet delivery stop is saved, since one leg of the V-shaped formation always has the correct position to one of the predetermined angles.

A corresponding embodiment of the sheet feed guide ensures that the positioning of the sheet material in the receiving slots is always exact.

For example, there can be at least one transport roller for the sheet material on the sheet feed guide. But preferably there are two interacting transport rollers.

BRIEF DESCRIPTION OF THE DRAWINGS

The invention is explained below using the drawings.

DETAILED DESCRIPTION OF THE INVENTION

Figure 1:
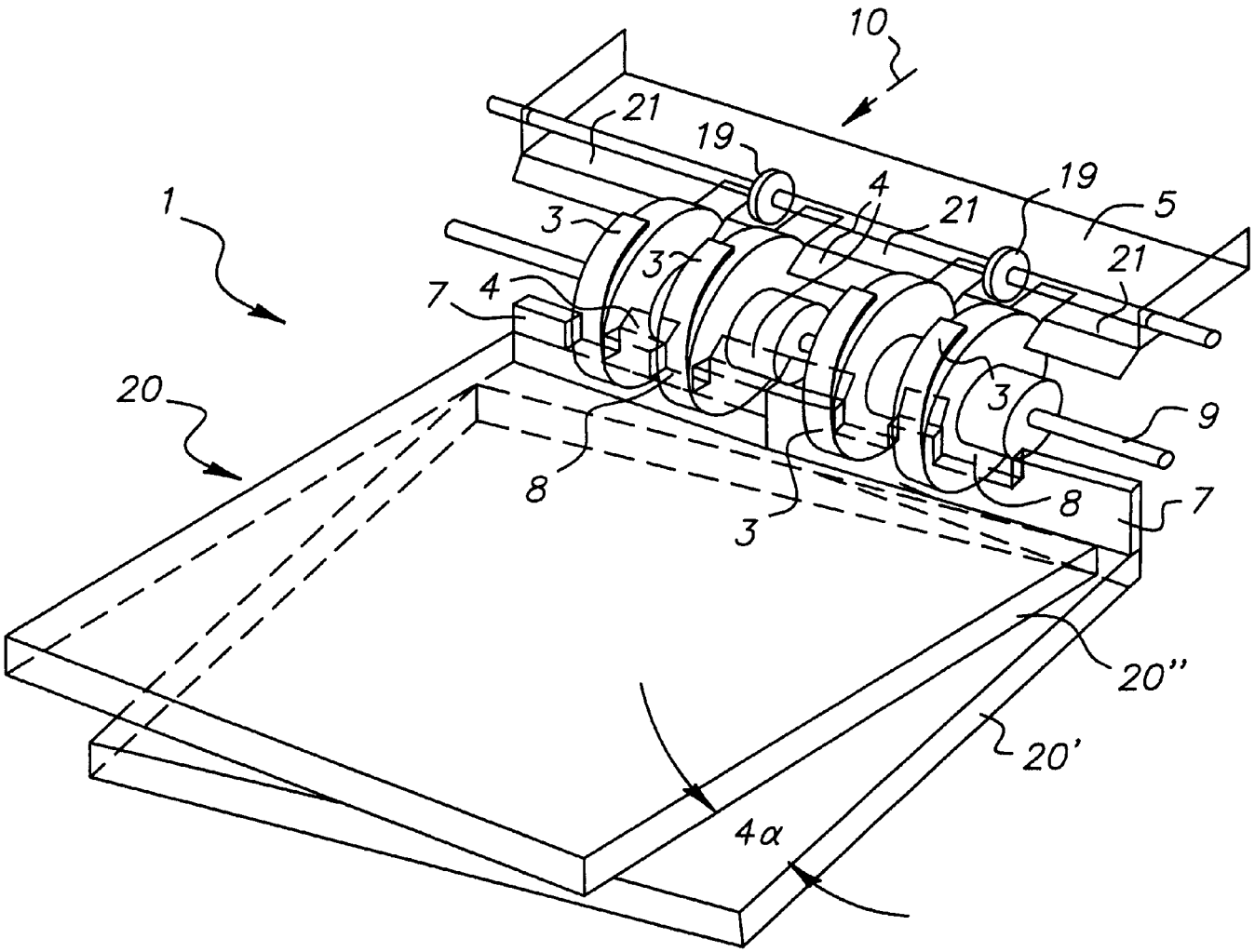
FIG. 1 shows important functional elements of one embodiment of the invention in a perspective view.

FIG. 1 shows important functional elements of one embodiment of the sheet delivery device 1 according to the invention in a perspective view. The sheet delivery stop 1 includes a sheet feed device 5 and at least two deflection wheels. In this embodiment there are four which are located on one shaft 9. The deflection wheels 3 have receiving slots 4 which are located in the same positions with respect to one revolution in the direction of arrow 25 (see FIG. 3), here for each deflection wheel 3 there being two receiving slots 4 which are arranged offset by 180°. Offset by roughly 180° relative to the sheet feed device 5—here this is the lower region of the deflection wheels 3—there is the sheet delivery stop 7 which has recesses 8 in which the deflection wheels 3 move.

It is provided in the invention that the shaft 9 with the deflection wheels 3 can be moved out of the position, which is perpendicular relative to the transport direction 10 into an inclined position. This results in that the sheets incoming in the transport direction 10 on the sheet feed device 5 (not shown here) are inserted into the receiving slots 4 of the deflection wheels 3 wherein the receiving position 6 (see FIG. 3), the receiving slots 4 also being inclined relative to the transport direction 10 by the inclination of the shaft 9. When the deflection wheels 3 are turned by a drive or because they were bumped by the sheet to the delivery position 17, one sheet is raised by the sheet feed device 5, the sheet end 26 (see FIG. 3) becoming the sheet start by the turning of the sheet. When the receiving slots 4 travel into the lower area, the sheet bumps against the sheet delivery stop 7 and is pushed by the latter out of the receiving slots 4 and deposited on the delivery stack 20. By reversing the sheet by 180° the angle of incline of the sheet is doubled relative to the inclination of the shaft 9 so that a corresponding angular offset in the delivery stack 20 is achieved.

If the shaft 9 is swiveled once out of its vertical position in one direction of rotation relative to the transport direction 10 and swiveled by the same angle in the other direction for delivery of one part 20" of the stack which is offset relative to the first part 20' of the stack, this results in that stack parts 20' and 20" are formed which have an angular offset by four times the inclination of the shaft 9. When therefore the shaft 9 is inclined by an angle $\alpha$, the inclination of the stack parts 20' and 20" against one another is four times the angle $\alpha$.

The sheet delivery stop 7 extends beside the recess 8 to the top such that it lies beside the receiving slots 4 when they reach the sheet delivery position 17, by which the sheets bump the stop 7, are pushed out of the receiving slots 4 and deposited. This is detailed using FIG. 3.

Figure 2:
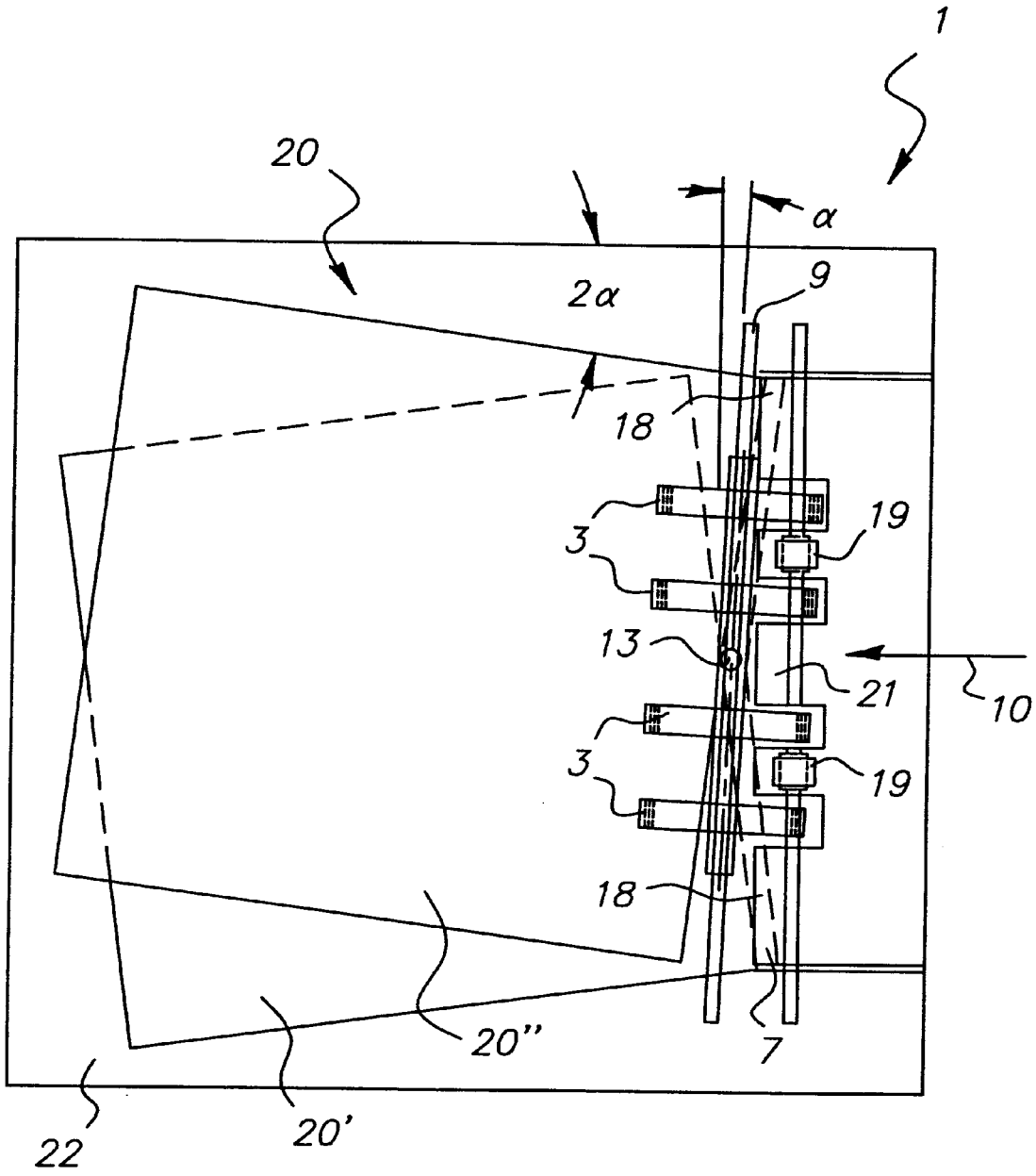
FIG. 2 shows a plan view of the article of FIG. 1.

FIG. 2 shows a plan view of the sheet delivery device 1 shown in FIG. 1. Here it can be seen that the sheet feed device 5 is equipped preferably with transport rollers 19 which are located in areas of the guide plates 21 which lie in the manner of a tongue between the deflection wheels 3. In this way reliable transport of the sheets into the receiving slots 4 of the deflection wheels 3 is ensured. The lateral offset of the shaft 9 by the angle $\alpha$ by swiveling around the swiveling axis 13 yields the first inclined position of the sheets by the angle $\alpha$, this angle $\alpha$ being doubled to an angle $2\alpha$ by turning the sheets and as they are deposited on the tray 22.

This figure furthermore shows that the sheet delivery stop 7 is made V-shaped the two legs 18 each having an angle $\alpha$ from the perpendicular to the transport direction 10. In this way one sheet with the original front 26 (see FIG. 3) which becomes the back by turning arrives at one of the legs 18 such that the edge of the sheet is parallel to the leg 18. If the shaft 9 is deflected once in one and then in the other direction by the angle $\alpha$ to the perpendicular to the transport direction 10, the stack offset of the stack parts 20' and 20" which has already been described for FIG. 1 and which is likewise shown there takes place, of course other stack parts 20'", 20"" etc. can be deposited offset on the tray 22 in any sequence.

Figure 3:
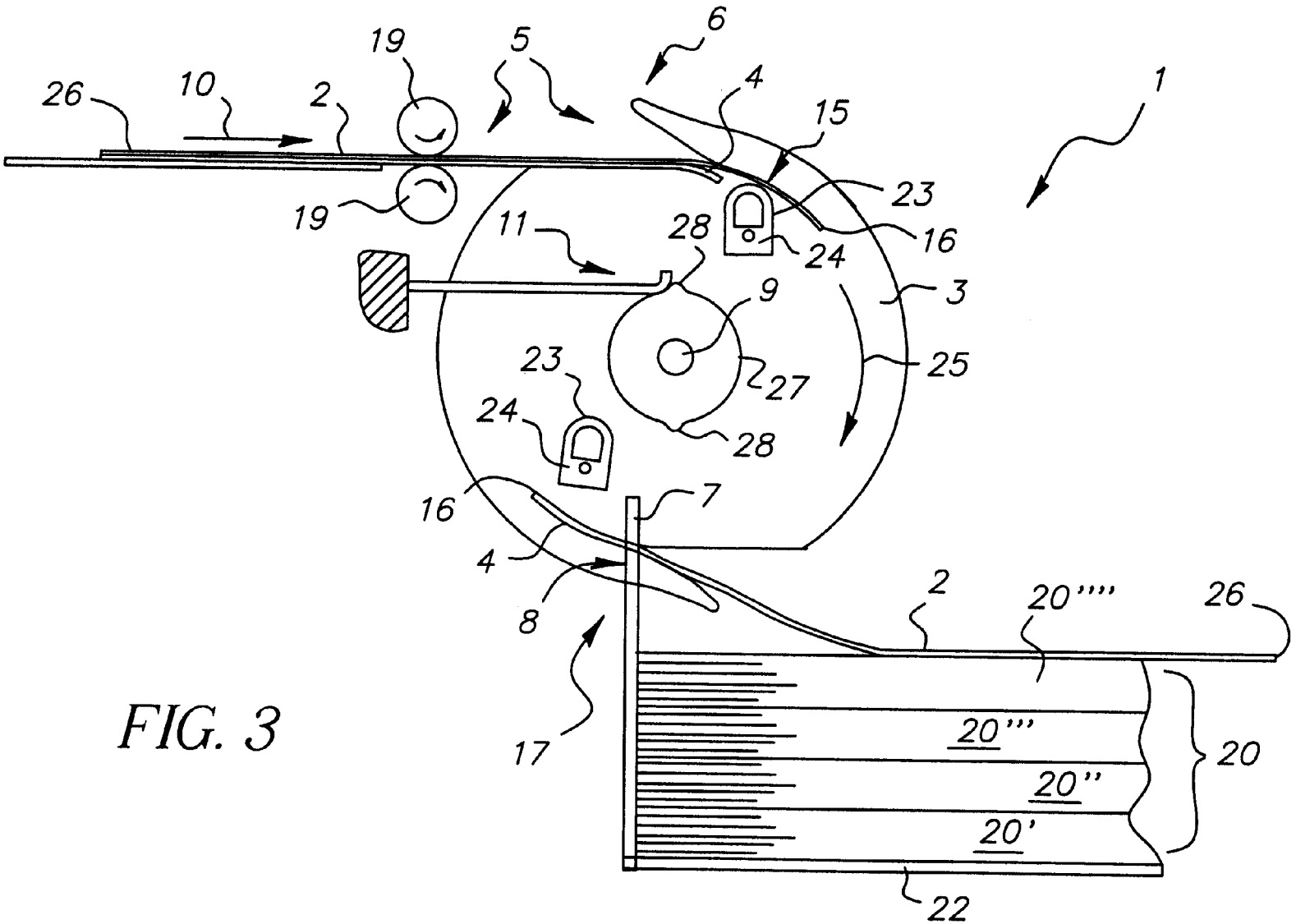
FIG. 3 shows a side view of one embodiment with additional functional elements.

FIG. 3 shows a side view of one embodiment of the sheet delivery device 1 in the invention with other functional elements. Here the sheet feed device 5 is brought forward somewhat against the transport direction 10 in order to be able to display the area of insertion of the flexible sheet material 2—therefore the sheets—into the receiving slots 4 exposed. Of course, an embodiment as described for FIG. 2 is also useful here.

In this representation the sheet delivery device 1 is shown in a side view compared to FIG. 2, there being a braking device 11 for the deflection wheels 3 as another functional element. The braking device 11 includes a cam disk 27 which is located on the shaft 9 and which has elevations 28. An elastic element 29 interacts with this cam disk 27 and is arranged and made such that it always stops the deflection wheels 2 when the elastic element 29 runs against one of the elevations 28. In this position the upper receiving slot 4 is in its receiving position labeled by the arrow 6 and the lower receiving slot 4 is in its sheet delivery position labeled by the arrow 17.

So that no rebound against the stops 16 (end of receiving slots 4) occurs due to the speed of the flexible sheet material 2, there is a braking device 15 for the sheet materials 2. The sheet braking device 15 includes a bracket 23 and an eccentrically supported weight 24. The weight 24 provides for the brackets 23 to always be pointed up and thus, when the deflection wheel 3 is in the receiving position 6, reduces the speed of the flexible sheet material 2 such that no rebound against the stops 16 occurs.

When the deflection wheels 3 continue to turn in the direction of the arrow 25 by 180°, the front edge of the sheet in the sheet delivery position 17 strikes the sheet delivery stop 7, by which the flexible sheet material 2 is pushed out of the receiving slots 4 and is deposited on the tray 22. Since the eccentrically supported weights 24 also hold the brackets 23 to the top here, the latter are moved out of their catches in the receiving slots 4 and thus cannot prevent removal of the flexible sheet material 2.

In the described process the sheet material 2 has been turned such that the former end 26 of the sheet now lies in front on the tray 22. In this figure it is also clear how the receiving slots 4 are widened in a V-shape at the start of the slot in order to ensure reliable insertion of the sheet material 2. Furthermore, it can be seen how the delivery stack 20 contains several stack parts 20', 20", 20''', 20"" which each have the aforementioned angular offset.

Figure 4:
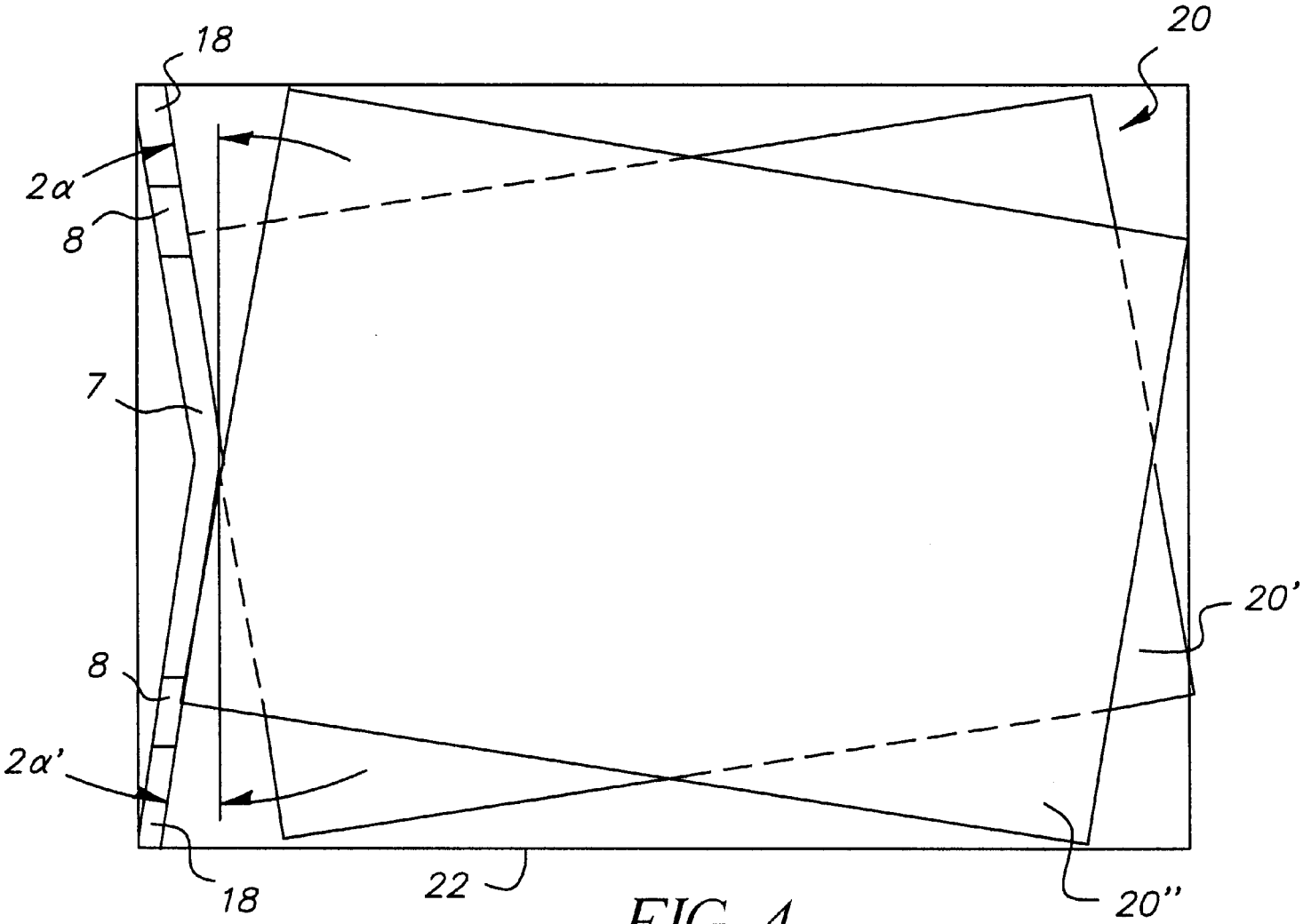
FIG. 4 shows one embodiment of a tray.

FIG. 4 shows one embodiment of a tray 22, the other already described parts being omitted in order to better see the tray 22. In the already described manner the sheet delivery stop 7 is made with legs 18 which are arranged in a V shape and which are each offset by the angle $2\alpha$ which is twice the angle of the inclination which is provided for the shaft 9. This results in a neater contact of the sheets 2 with the sheet delivery stop 7, since the sheets have already passed into the angular offset $\alpha$ by the deflection wheels 3. But it should be noted that the angular offset was drawn exaggerated, in fact a far smaller offset is necessary to achieve the initially described purpose of the invention.

Figure 5:
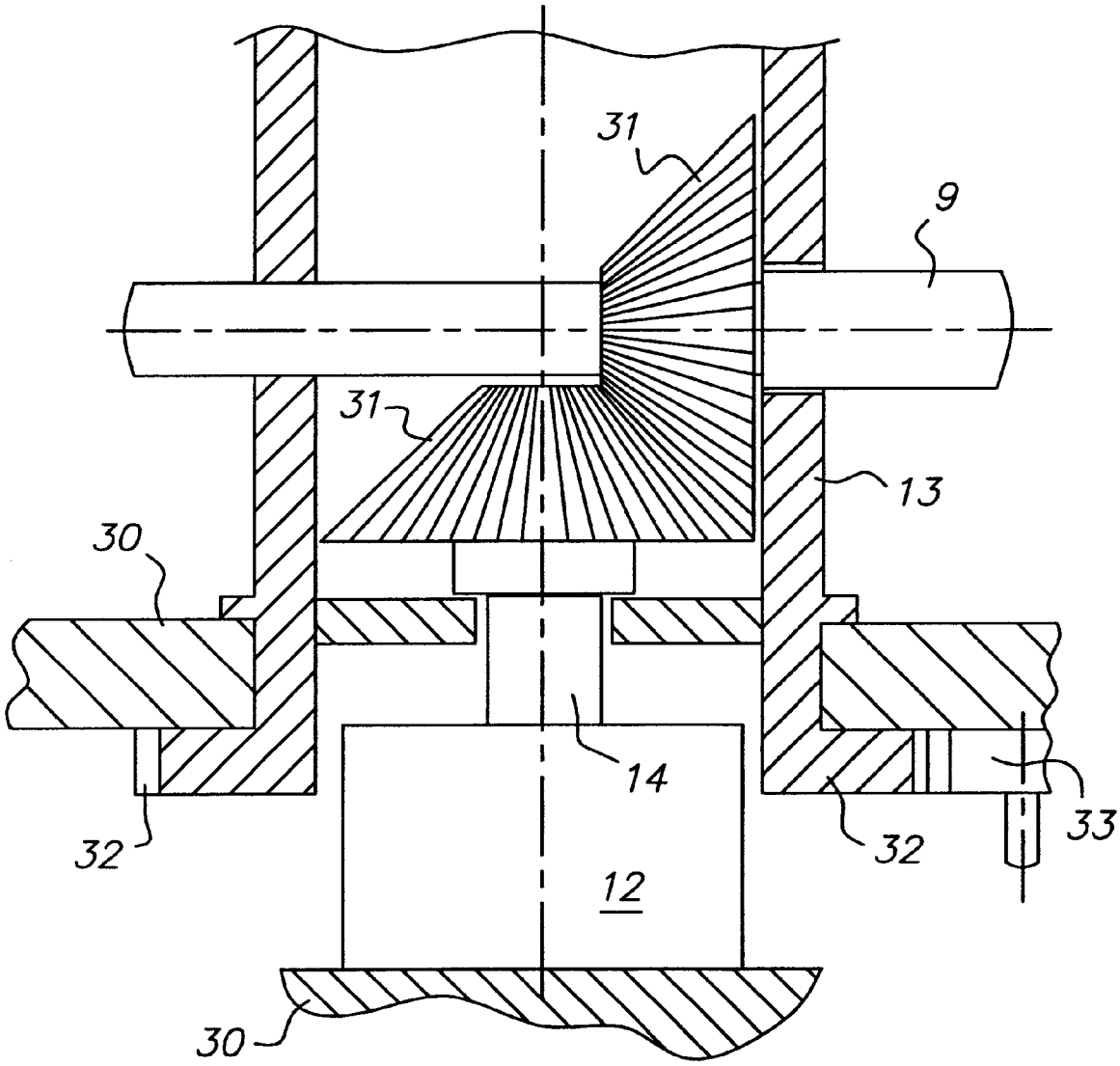
FIG. 5 shows one embodiment with the drive of the shaft and the swiveling axis.

FIG. 5 shows one embodiment of a drive 12 with the shaft 9 and the swiveling axis 13. For the drive of the shaft 9 and to swivel the shaft 9, the swiveling axis 13 is made as a hollow shaft 13' in which a power transmission shaft 14, driven by the drive 12, runs centered. The drive 12 is located in the machine housing 30 and the hollow shaft 13' is pivotally supported in the machine housing 30. The power from the power transmission shaft 14 is transferred to the shaft 9 by gearing, and for example there can be two bevel gears 31 to transfer the rotary motion of the power transmission shaft 14 to the shaft 9. The hollow shaft 13' is selectively swiveled about swiveling axis 13 by a crown gear 32 connected in the hollow shaft and a gear drive 33. The crown gear 32 associated with the drive gear 33 effects the swiveling motion about axis 13 for the shaft 9 and holds the shaft against swiveling.

The aforementioned embodiments are of course only examples and not all the functional elements of the invention as can be taken from the part of the specification which does not relate to the drawings are shown. The most varied combinations are possible, for example the drive 12 can be combined with the braking device 11, or it is possible for the drive 12 to undertake positioning itself by there being for example a stepping motor. The inclined position 9 about the swiveling axis 13 is simply one example, there can also be an actuating element which engages in the outside area of one bearing of the shaft 9, or a different way of producing swiveling motion is possible. The sheet feed device 5 can also be made in different ways. What is important is simply that neat feed of the sheets to the receiving slots 4 occurs; to do this a guide plate 21 or also transport rollers 19 arranged in different ways can be used only if they provide for neat feed to the receiving slots 4. Upstream machines, for example the distributor of a printing machine, can of course also be used for this purpose.

The invention has been described in detail with particular reference to certain preferred embodiments thereof, but it will be understood that variations and modifications can be effected within the spirit and scope of the invention.

Parts List

Reference Number List:

1 sheet delivery device
2 flexible sheet material, for example, paper
3 deflection wheel
4 receiving slot
5 sheet feed device
6 arrow: receiving position
7 sheet delivery stop
8 recess
9 shaft
10 transport direction
11 braking device for the deflection wheels
12 drive
13 swiveling axis
14 13' hollow shaft
15 braking device for the sheet material
16 slot end of the receiving slots
17 arrow: sheet delivery position
18 leg of the V-shaped sheet delivery stop
19 transport roller
20 delivery stack
20', 20"
20''', 20"" parts of the stack with offset
21 guide plate
22 tray
23 bracket
24 eccentrically supported weights
25 arrow: direction of rotation of the deflection wheel
26 end of the sheet
27 cam disk
28 elevations of the cam disk
29 elastic element
30 machine housing
31 bevel gears
32 crown gear
33 gear for swiveling motion

What is claimed is:

1. Offset sheet stacker device for flexible sheet material, said offset sheet stacker comprising:

at least one deflection wheel, mounted on a shaft, said at least one deflection wheel having at least one receiving slot which is respectively located essentially tangentially to said at least one deflection wheel, said at least one deflection wheel being rotatable about said shaft to position said at least one receiving slot in a sheet receiving position or a sheet delivery position, a sheet feed device which discharges sheets into said at least receiving slot when said at least one receiving slot is in said receiving position, and a sheet delivery stop in the area of said at least one deflection wheel opposite the receiving position, said at least one deflection wheel running in a recess of the sheet deliver stop and the latter lying in said sheet delivery position at least on one side of the receiving slot, said shaft being inclined relative to the transport direction of the sheet feed device so that the angular position of said shaft relative to said sheet delivery stop is such that the inclination of said sheet delivery stop always corresponds to twice the angle of inclination of said shaft.

2. Offset sheet stacker device as recited in claim 1, wherein said at least one deflection wheels has two receiving slots which are offset by 180°.

3. Offset sheet stacker device as recited in claim 1, including a braking device which stops said at least one deflection wheels in at least one sheet receiving position.

4. Offset sheet stacker device as recited in claim 1, wherein said shaft can be swiveled around a swiveling axis perpendicular to the plane of a sheet in said sheet feed device.

5. Offset sheet stacker device as recited in claim 4, said swiveling axis is the axis of a hollow shaft containing a power transmission shaft of a drive for said shaft upon which said at least one deflection wheel is mounted.

6. Offset sheet stacker device as recited in claim 5, wherein each of said receiving slots is V-shaped from the entrance of said slot to the apex, said apex providing a sheet stop.

7. Offset sheet stacked device as recited in claim 6, wherein on at least one receiving slot there is a braking device for the sheet which reduces sheet speed in front of said stop on the slot end such that no sheet rebounding occurs from said stops.

8. Offset sheet stacker device as recited in claim 7, wherein said braking device is an elastic brackets which is located in the area of a receiving slot and which is in a friction relation relative to a sheet as it enters said receiving slot.

9. Offset sheet stacker device as recited in claim 7, wherein said braking device is an elastic bracket which is located in the area of a receiving slot and which can be moved into the insertion path of the sheet and released from the sheet in the sheet delivery path.

10. Offset sheet stacker device as recited in claim 9, wherein said braking device passes into the engagement and release of a sheet by an eccentrically supported weight attached to said elastic bracket.

11. Offset sheet stacker device as recited in claim 10, wherein said shaft upon which said at least one deflection wheel is mounted can be inclined from the perpendicular to the transport direction in both directions by a predetermined angle and wherein said sheet delivery stop is made V-shaped, each leg of the V having twice the angle as the angle predetermined for said shaft.

12. Offset sheet stacker device as recited of claim 11, wherein there is at least one transport roller for the sheet on said sheet feed device.

13. Offset sheet stacker device as recited in claim 12, wherein there are two interacting transport rollers.

* * * * *